US007496319B2

(12) United States Patent
Takashima et al.

(10) Patent No.: US 7,496,319 B2
(45) Date of Patent: Feb. 24, 2009

(54) IMAGE FORMING APPARATUS, ROTATION TYPE DEVELOPMENT UNIT, AND TONER REPLENISHMENT CONTAINER

(75) Inventors: Yoshiyuki Takashima, Ebina (JP); Junichiro Sameshima, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 231 days.

(21) Appl. No.: 11/508,898

(22) Filed: Aug. 24, 2006

(65) Prior Publication Data

US 2007/0183812 A1 Aug. 9, 2007

(30) Foreign Application Priority Data

Feb. 9, 2006 (JP) ..... 2006-033004

(51) Int. Cl.
*G03G 15/01* (2006.01)

(52) U.S. Cl. ..... 399/227

(58) Field of Classification Search ..... 399/107, 399/119, 222, 226, 227
See application file for complete search history.

(56) References Cited

U.S. PATENT DOCUMENTS 6,295,429 B1 * 9/2001 Isobe et al. ..... 399/227
6,546,220 B1 * 4/2003 Asakura et al. ..... 399/227
RE38,164 E * 7/2003 Wagi et al. ..... 358/300
6,983,115 B2 * 1/2006 Isobe et al. ..... 399/119
7,072,605 B2 * 7/2006 Kishigami ..... 399/227

FOREIGN PATENT DOCUMENTS

JP A-07-295374 11/1995
JP A-07-319275 12/1995
JP A-08-160699 6/1996
JP A-08-305114 11/1996
JP A-09-106159 4/1997

* cited by examiner

*Primary Examiner*—Hoan H Tran
(74) *Attorney, Agent, or Firm*—Morgan, Lewis & Bockius LLP

(57) ABSTRACT

An image forming apparatus includes: a casing; a developer having a plurality of developers and a rotational body that is rotatably supported on the casing, the plurality of developers being able to be mounted with a toner replenishment container filled with toner, and being disposed on a peripheral surface of the rotational body; a replacement door that opens the replacement hole when opened and closes the replacement hole when closed; and a pressing portion that presses the toner replenishment container that is inserted into the replacement hole into a mounting position of the developer under interlocking with a closing operation of the replacement door and mounts the toner replenishment container to the mounting position of the developer, and is fastened to the casing after mounting in a state apart from the rotation type developer.

12 Claims, 14 Drawing Sheets

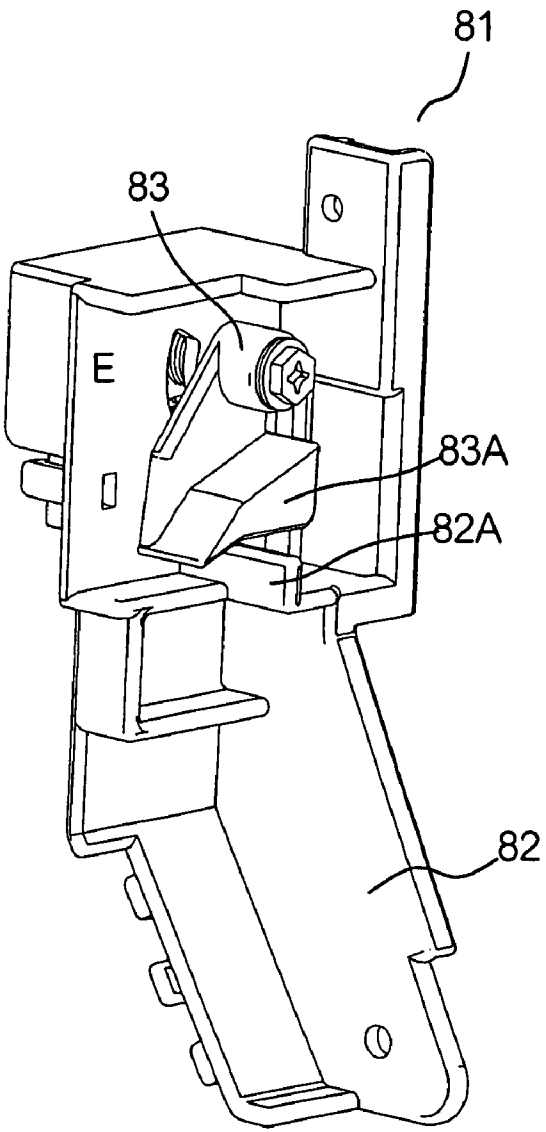
FIG. 10
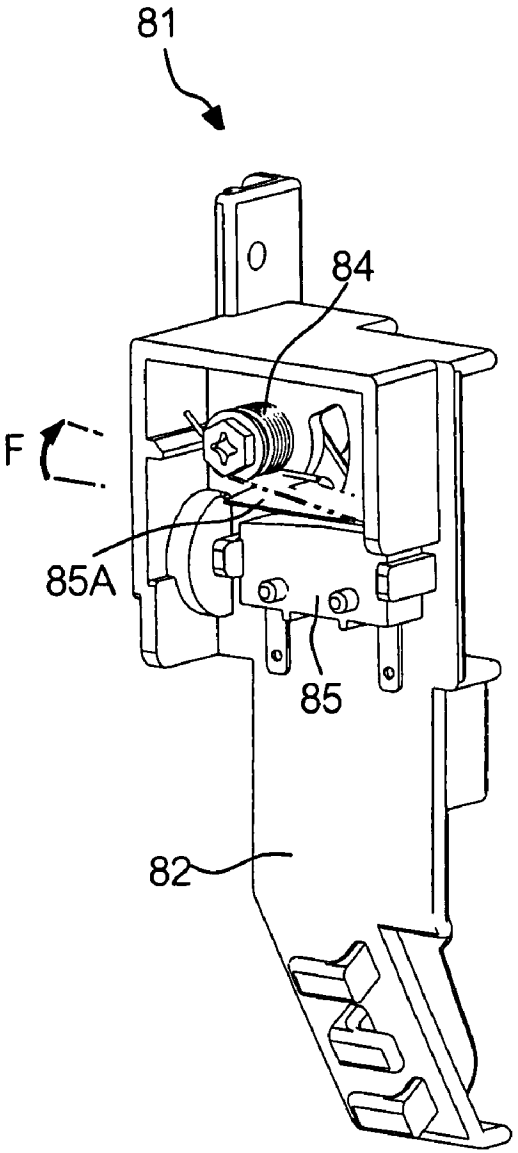

IMAGE FORMING APPARATUS, ROTATION TYPE DEVELOPMENT UNIT, AND TONER REPLENISHMENT CONTAINER

BACKGROUND

1. Technical Field

The present invention relates to techniques for replacing toner replenishment containers in rotary type image forming apparatuses including multiple developers on a rotational body.

2. Related Art

So-called rotary type image forming apparatuses are known that use a rotation type development unit in which multiple developers are arranged on a peripheral surface of a rotational body to develop electrostatic latent images formed on a photosensitive drum. In these apparatuses, the rotation type development unit is rotated to bring a developer in opposition to the photosensitive drum and an electrostatic latent image on the surface of the photosensitive drum is developed by a toner of a first color from this developer, then a different developer is brought in opposition to the photosensitive drum and an electrostatic latent image on the surface of the photosensitive drum is developed by a toner of a second color from this developer, and so on such that the toner images on the photosensitive drum are superimposed on each other by carrying out a development operation for each color toner in order.

Generally, toner replenishment containers referred to toner cartridges or the like are mounted in the rotation type development unit and a suitable amount of toner is supplied to the developers from the toner replenishment containers.

SUMMARY

The present invention provides an image forming apparatus.

According to an aspect of the invention, an image forming apparatus, comprises: a casing; a rotation type development unit having a plurality of developers and a rotational body that is rotatably supported on the casing, the plurality of developers being able to be mounted with a toner replenishment container filled with toner, and being disposed on a peripheral surface of the rotational body; the casing defining a replacement hole that is provided in a position that links to a mounting position at which the toner replenishment container of one of the developers is to be mounted when the rotational body stops rotating at a predetermined position, the toner replenishment container inserting into the replacement hole when the toner replenishment container mounts into the developer; a replacement door that opens the replacement hole when the replacement door is opened and closes the replacement hole when the replacement door is closed; and a pressing portion that presses the toner replenishment container that is inserted into the replacement hole into a mounting position of the developer under interlocking with a closing operation of the replacement door, and mounts the toner replenishment container to the mounting position of the developer, and is fastened to the casing after mounting in a state apart from the rotation type development unit.

BRIEF DESCRIPTION OF THE DRAWINGS

Embodiments of the present invention will be described in detail based on the following figures, wherein:

FIG. 10 is a perspective view of a latch according to an embodiment of the present invention;

DETAILED DESCRIPTION

<Configuration>

<Multi-Function Machines>

First, the overall configuration of an image forming apparatus is described simply.

Figure 1:
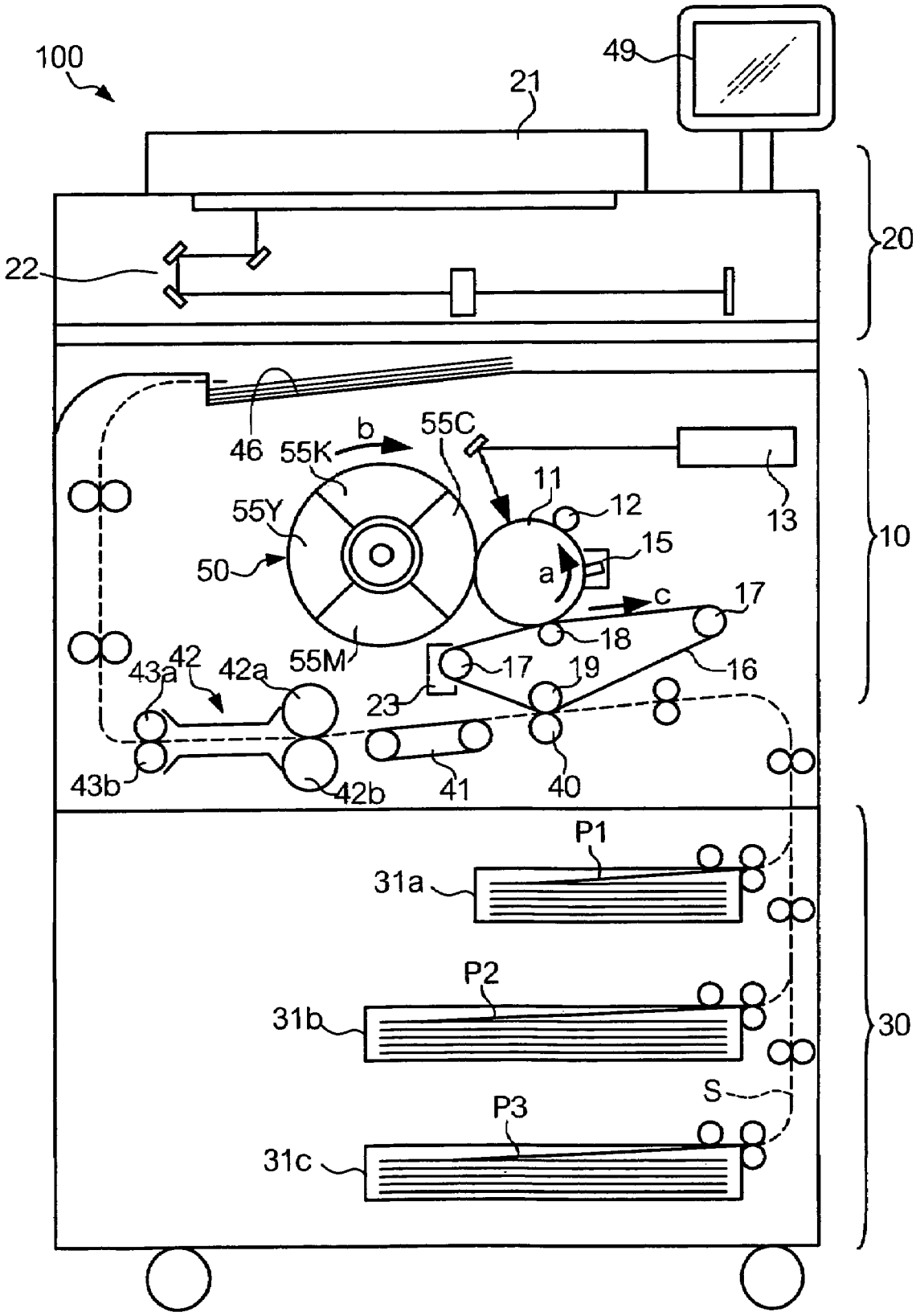
FIG. 1 shows a rotary type image forming apparatus according to an embodiment of the present invention.

FIG. 1 shows a configuration of a multi-function machine 100 including a rotary type image forming unit according to an embodiment of the present invention. The multi-function machine 100 has a function of a color printer or a color copying machine for example, or has a combination of these functions. As shown in FIG. 1, the configuration of the multi-function machine 100 is broadly divided into an image forming unit 10, an image reading unit 20, and a paper supply unit 30. The paper supply unit 30 includes paper supply sources, namely paper trays 31*a*, 31*b*, and 31*c*, and carrying rolls and register rolls for carrying papers P1, P2, and P3 from the paper supply sources to the image forming unit 10 via a carry path indicated by a dashed line S in the drawing. The image reading unit 20 includes a document feeding device 21, and an optical system unit 22 including a CCD (charge coupled device) or the like. The image reading unit 20 uses the optical system unit 22 to read images of documents placed in order on a platen glass (not shown) by the document feeding device 21 and generates image data representing the images that have been read.

The image forming unit 10 carries out an image forming process based on image data such as the image data generated by the image reading unit 20 and image data received via a communications interface (not shown). The image forming unit 10 includes a photosensitive drum 11, a charging device 12, an exposure device 13, a rotation type development unit 50, a cleaning blade 15, an intermediate transfer belt 16, support rolls 17, a primary transfer roll 18, a secondary transfer roll 19, an opposing roll 40, a carrying belt 41, and a fixing device 42. A photosensitive layer is formed on an outer peripheral surface (drum surface) of the photosensitive drum 11 and the photosensitive drum 11 is rotated in an "a" arrow direction shown in the drawing by a drive mechanism (not shown). The charging device 12 is a roll type charging device or a corotron type charging device for example and uniformly charges the surface of the photosensitive drum 11 to a predetermined electric potential. The exposure device 13 applies, to the photosensitive drum 11, which has been charged uniformly, a laser beam that is modulated according to the image data to form an electrostatic latent image on the surface of the photosensitive drum 11.

The rotation type development unit 50 includes developers 55Y, 55M, 55C, and 55K that contain toner (developing agent) of the colors Y (yellow), M (magenta), C (cyan), and K (black) respectively. By rotating the rotation type development unit 50 in a "b" arrow direction shown in the drawing using the driving mechanism (not shown), the four developers 55Y, 55M, 55C, and 55K can be moved in order to a position (development position) facing the photosensitive drum 11. Then, by causing each of the toners contained in the developers 55Y, 55M, 55C, and 55K to electrically transfer to the electrostatic latent image corresponding to those respective colors, an image forming operation can be carried out in which toner images are formed on the surface of the photosensitive drum 11.

The intermediate transfer belt 16 is an endless belt member and is caused to rotate in a "c" arrow direction while held in a tensioned state on its inner peripheral surface by multiple support rolls 17 (two shown in FIG. 1), the primary transfer roll 18, and the secondary transfer roll 19. The primary transfer roll 18 transfers (primary transfer) the toner image formed on the surface of the photosensitive drum 11 to the outer peripheral surface of the intermediate transfer belt 16 while sandwiching the intermediate transfer belt 16 between itself and the photosensitive drum 11. The cleaning blade 15 provided near the photosensitive drum removes toner remaining on the surface of the photosensitive drum 11 after primary transfer. The secondary transfer roll 19 transfers (secondary transfer) the toner image that has been transferred to the outer peripheral surface of the intermediate transfer belt 16 to a sheet of paper at a nip region formed between itself and the opposing roll 40. Toner remaining on the surface of the intermediate transfer belt 16 after secondary transfer is removed by a belt cleaner 23. While applying pressure using a fixing roll 42*a* and a pressure roll 42*b*, the fixing device 42 fixes the toner image to the sheet of paper by rapidly heating the sheet on which the toner image has undergone secondary transfer. After this fixing process is completed, the sheet of paper is discharged by discharge rolls 43*a* and 43*b* to a paper discharge tray 46.

<Rotation Type Development Unit>

Figure 2A:
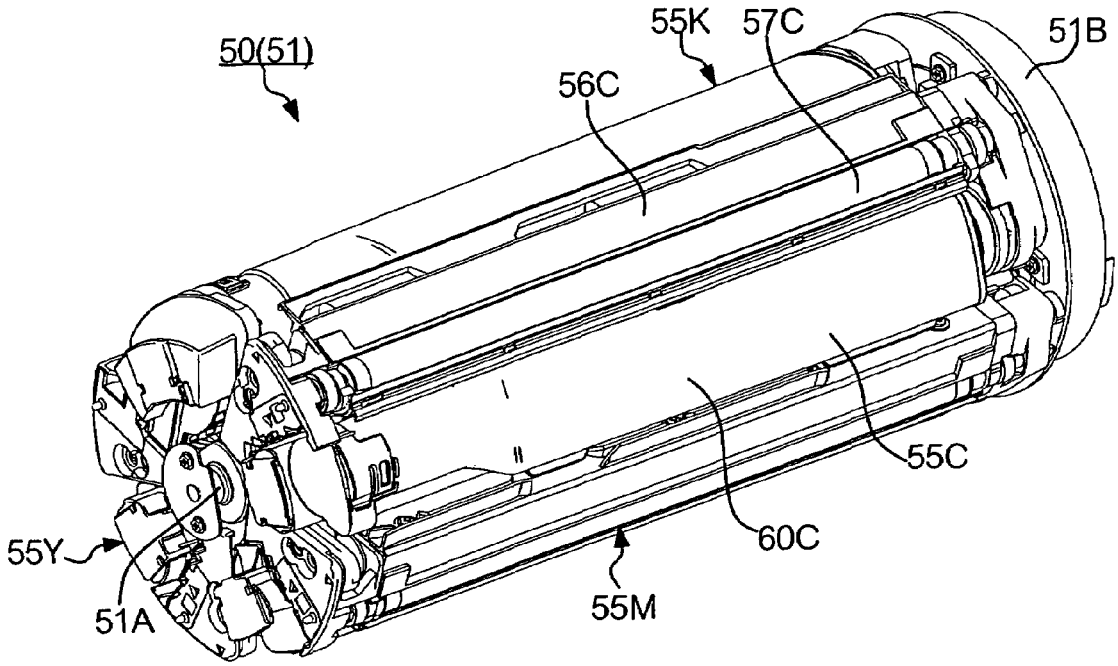
FIG. 2 is a perspective view of a rotation type development unit according to an embodiment of the present invention.
Figure 2B:
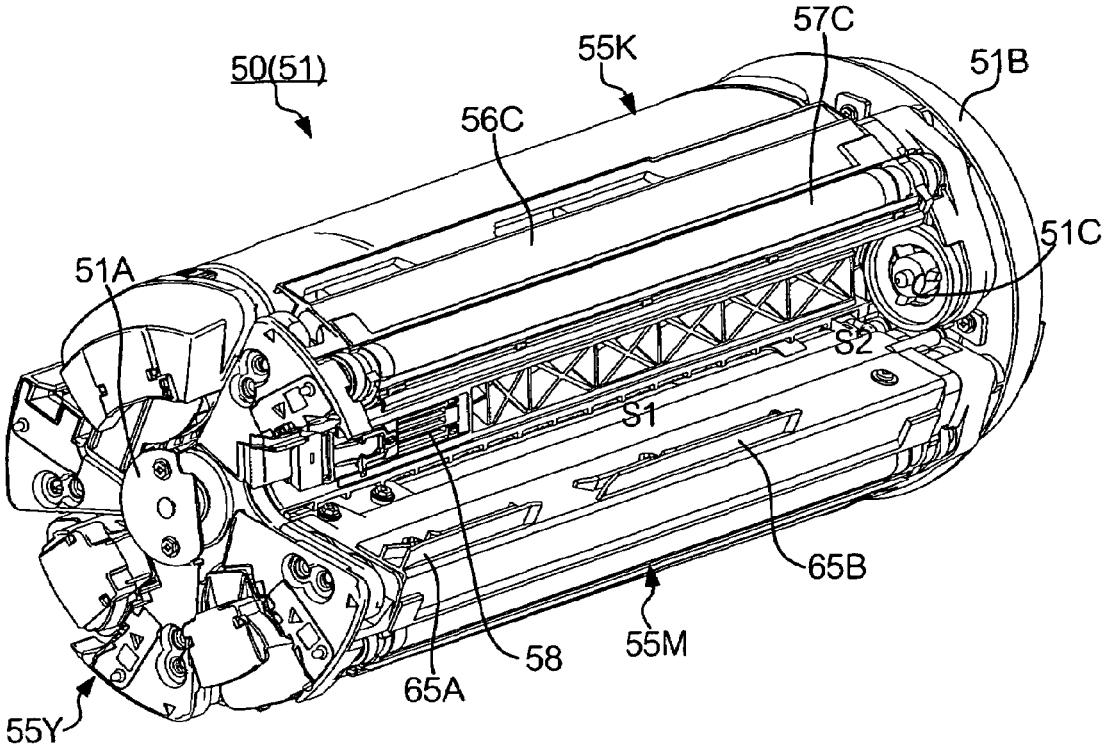
Figure 3:
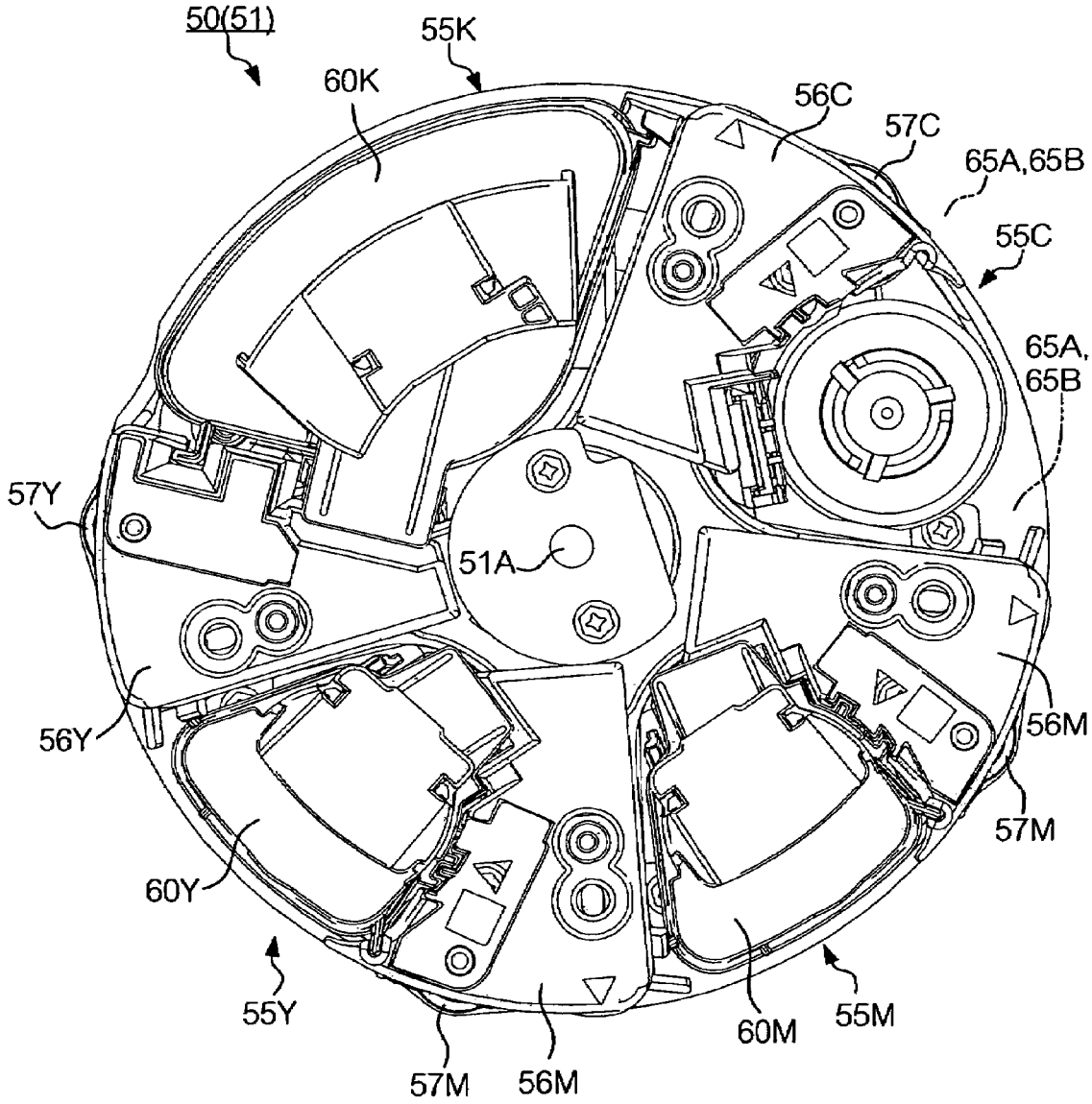
FIG. 3 is a side view of a rotation type development unit according to an embodiment of the present invention.

Next, a configuration of the rotation type development unit 50 is described with reference to FIGS. 2 and 3. FIG. 2 is a perspective view of the rotation type development unit 50 and FIG. 3 is a lateral view of the rotation type development unit 50.

A rotational shaft 51A of the rotational body 51 is rotatably supported on a casing (a casing 101 to be described later) of the multifunction machine 100. The four developers 55Y, 55M, 55C, and 55K are arranged on a peripheral surface of the rotational body 51. Furthermore, a disk shaped terminal piece 51B is formed at a back side of the rotational body 51 and at this terminal piece 51B is formed a male bracket 51C that links to an auger shaft of a toner cartridge 60, which will be described later.

In the following description, the suffixes Y, M, C, and K will be omitted when there is no particular need to differentiate these for description.

The developers 55Y, 55M, 55C, and 55K are equipped with developer bodies 56Y, 56M, 56C, and 56K, which have toner holding chambers and developer rolls 57Y, 57M, 57C, and 57K, and toner cartridges 60Y, 60M, 60C, and 60K, which are toner replenishment containers that mount into the developer bodies 56Y, 56M, 56C, and 56K and have fan-shaped cross sections and a columnar outer shape. It should be noted that in FIGS. 2B and 3, the toner cartridge 60C of the C-color developer 55C is shown in a removed state. The position in which the toner cartridge is mounted is the mounting position in which the toner cartridge of the developer 55 is mounted.

Figure 5A:
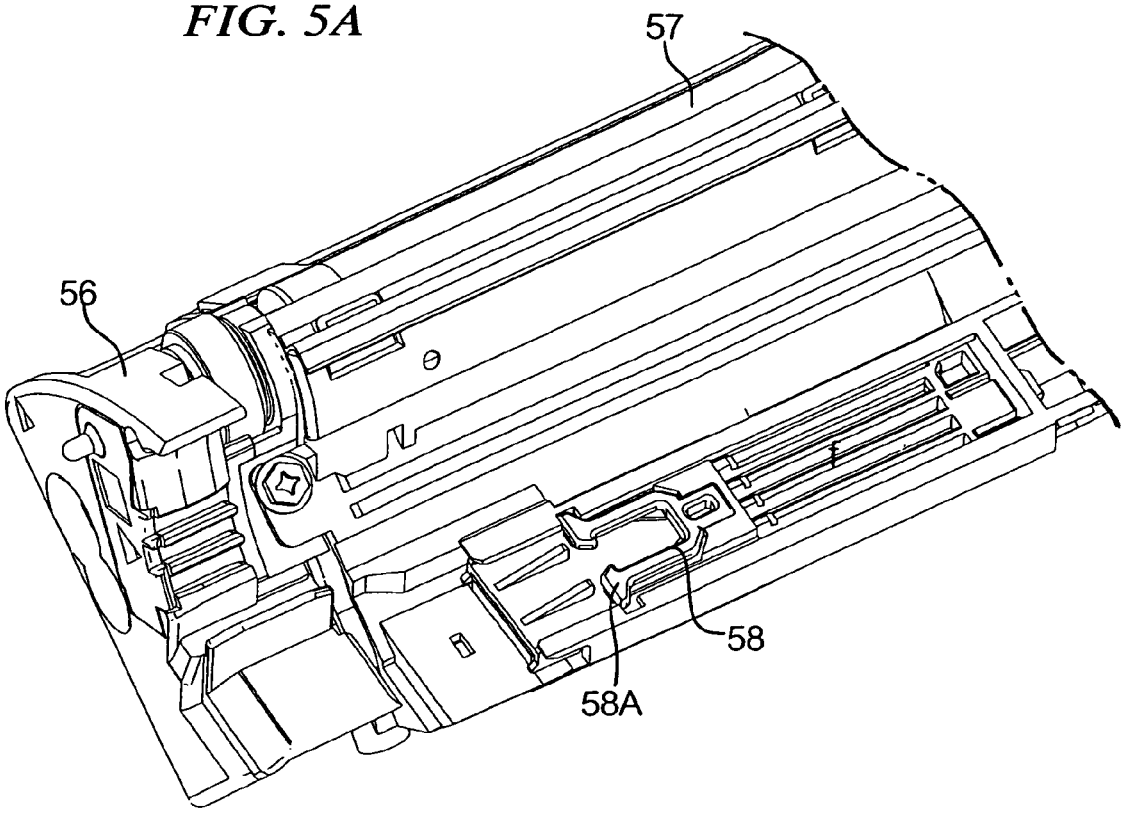
FIG. 5 shows a relevant part of a developer body according to an embodiment of the present invention.
Figure 5B:
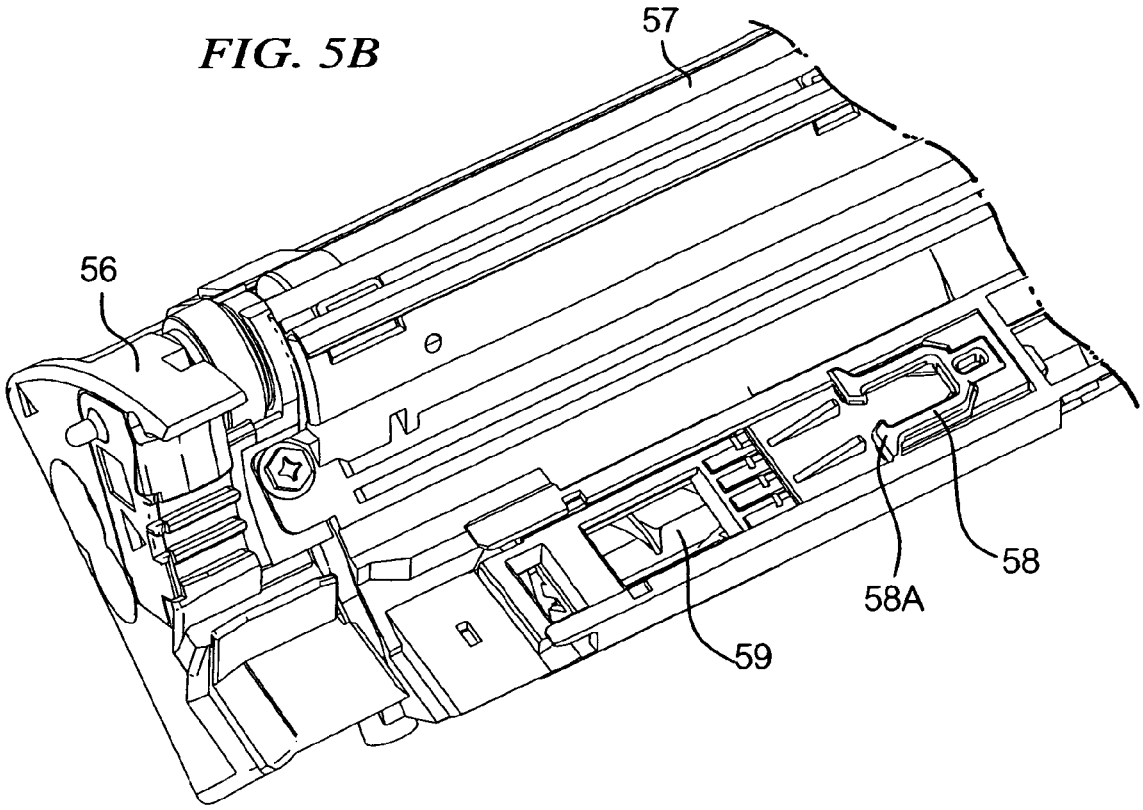

A toner replenishment outlet 59 for replenishing toner inside the toner holding chamber is formed as a hole in the developer body 56 and the toner replenishment outlet 59 is covered by a shutter 58. The toner replenishment outlet 59 opens (see FIG. 5) by moving the shutter 58 in an "f" arrow direction. Furthermore, an engaging claw 58A that protrudes slightly is formed in the shutter 58 and this engaging claw 58A engages with a shutter 61, which will be described later, on the toner cartridge 60 side when the toner cartridge 60 is inserted.

Figure 4A:
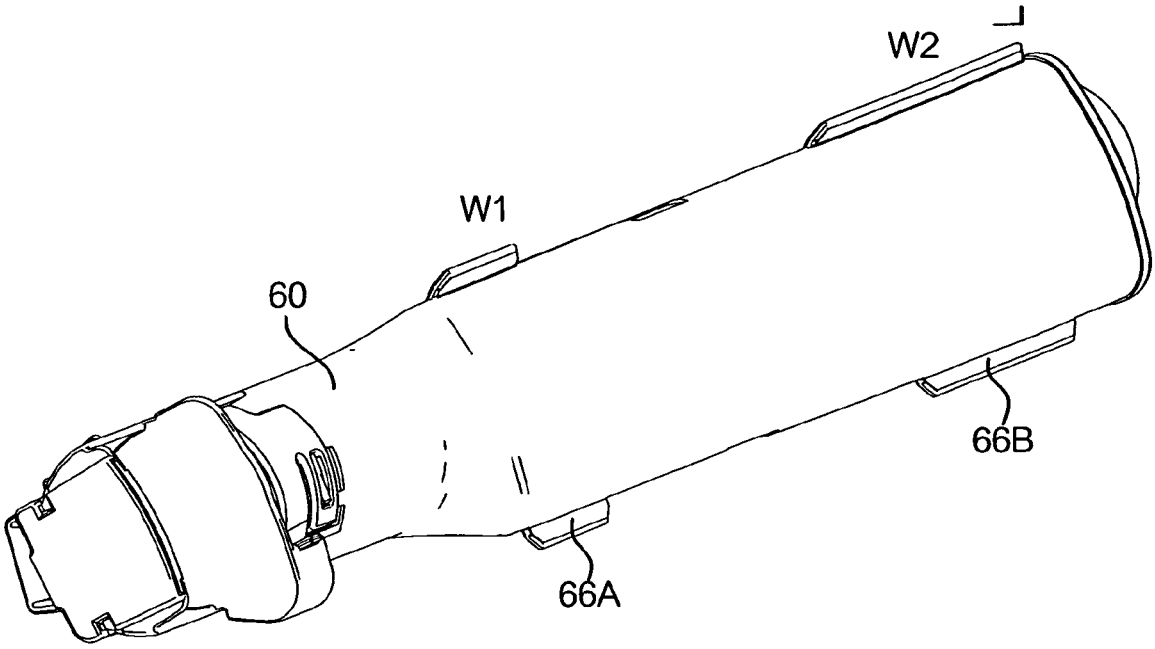
FIG. 4 is a perspective view of a toner cartridge according to an embodiment of the present invention.
Figure 4B:
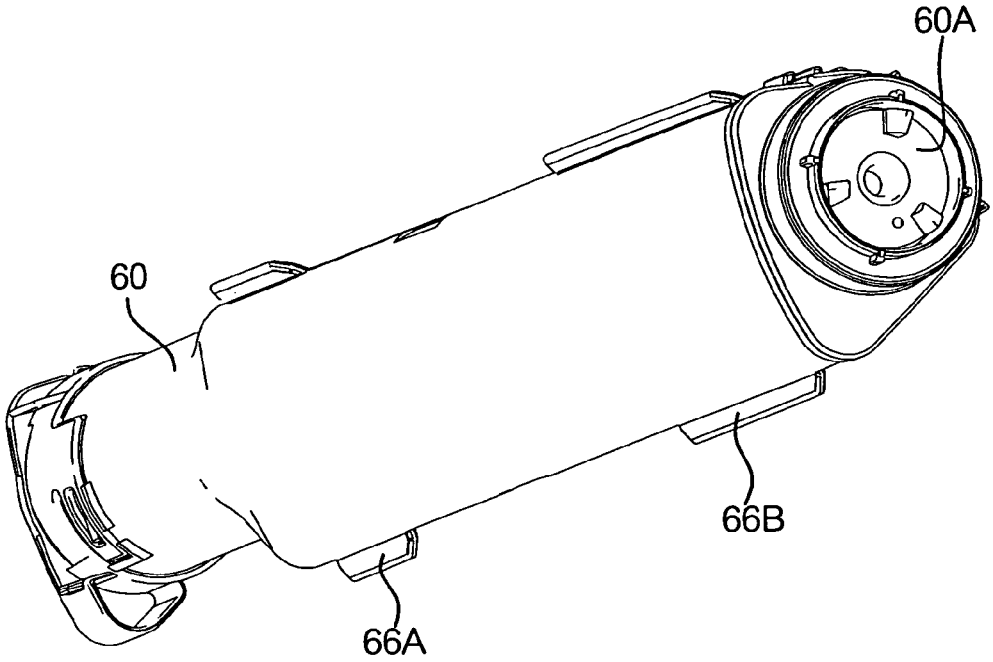
Figure 6A:
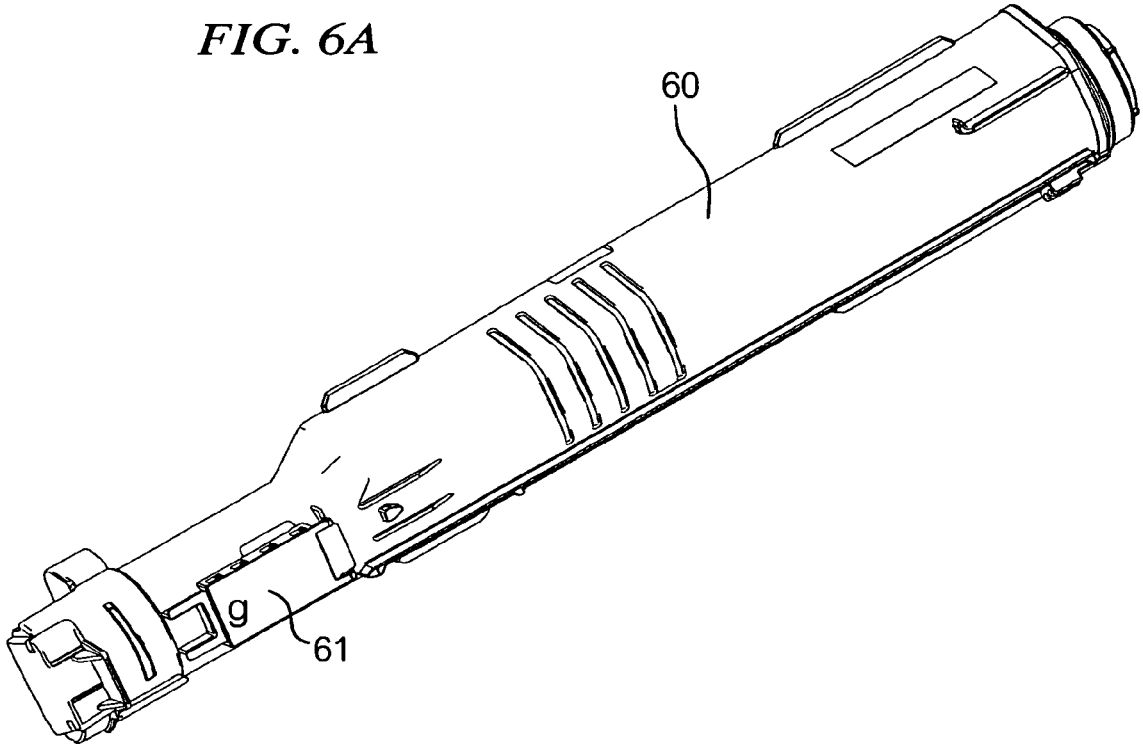
FIG. 6 is a perspective view of a toner cartridge according to an embodiment of the present invention viewed from a different direction than FIG. 4.
Figure 6B:
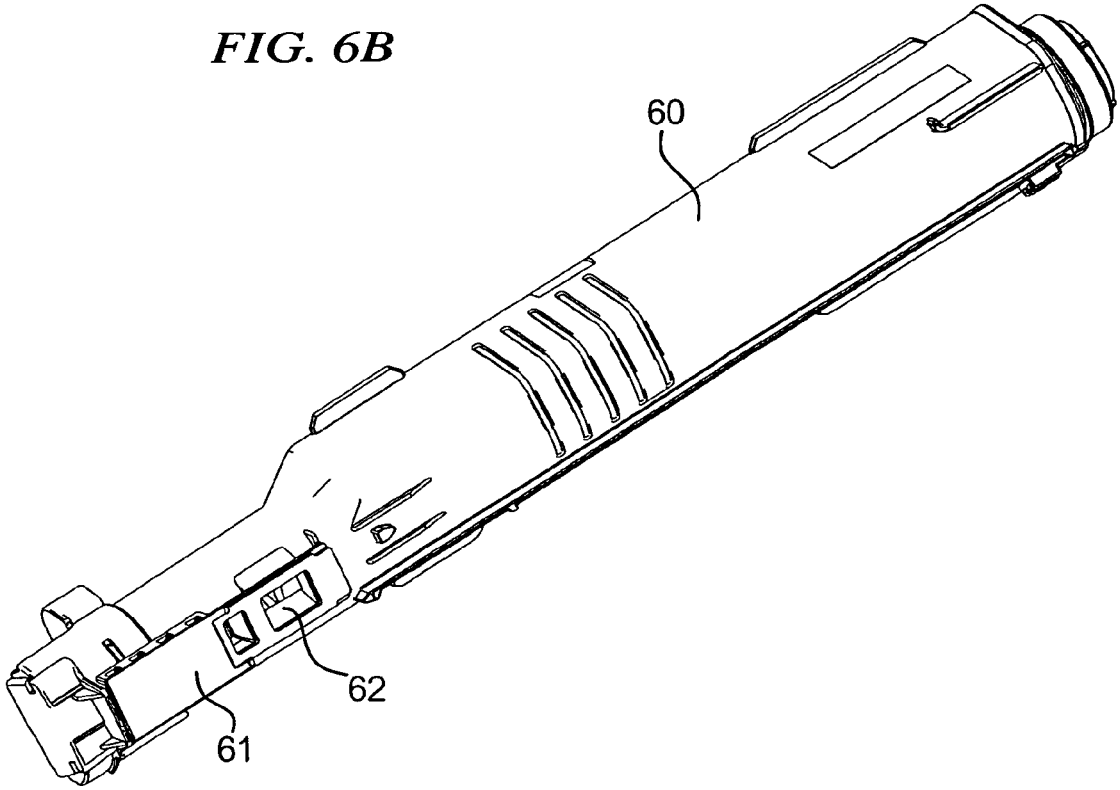

As shown in FIG. 6, the toner cartridge 60, which is a toner replenishment container, is mounted in the mounting position of the developer 55 by rotating the rotation type development unit 50 to a predetermined replacement position then inserting it from a predetermined insertion direction. On the other hand, the toner cartridge 60 is withdrawn from the mounting position of the developer 55 by being pulled out in reverse to the insertion direction. Furthermore, an agitating auger (not shown) for agitating toner in the container is rotatably provided in a lengthwise direction in the toner cartridge 60, a female bracket 60A that links to the male bracket 51C of the rotation type development unit 50 is formed at an end surface in the insertion direction of the toner cartridge 60, and this female bracket 60A links to the shaft of the agitating auger (see FIG. 4). The rotational force produced by the driving mechanism (not shown) positioned on the outer side of the rotation type development unit 50 is transmitted to the agitating auger through the male bracket 51C and the female bracket 60A, and toner inside the toner cartridge 60 is agitated by an agitating action of the agitating auger.

Furthermore, a replenishment outlet 62 is provided as a hole on a lateral surface of the starting end side in the insertion direction within the lengthwise direction of the toner cartridge 60. The replenishment outlet 62 is closed by the shutter 61 and the replenishment outlet 62 opens (see FIG. 6) by moving the shutter 61 in a "g" arrow direction. Then, when the toner cartridge 60 mounts into the developer body 56 (rotation type development unit 50), the shutter 61 of the toner cartridge 60 side engages with the shutter 61 on the developer body 56 side and both of these move in a direction for opening such that the replenishment outlets 59 and 62 open. Toner from the toner cartridge 60 is then replenished into the toner holding chamber through the replenishment outlets 62 and 59.

<Structure of Guide Member>

A guide member is formed between the developer bodies 56 neighboring each other and the toner cartridge 60. For example, as shown in FIG. 2B, since the C-color toner cartridge 60C inserts between the developer body 56C and the developer body 56M, the guide member is formed by the opposing surfaces of the toner cartridge 60C, the developer body 56C, and the developer body 56M.

The guide member has a pair of groove formation portions 65A and 65B, which are formed protruding to the developer body 56 side and are lined up with an interval therebetween on a same axis extending in the insertion direction, and a pair of plate shaped engaging protrusions 66A and 66B, which are formed protruding to the toner cartridge 60 side and are lined up with an interval therebetween on the same axis extending in the insertion direction. The engaging protrusions 66A and 66B are first guiding portions and the groove formation portions 65A and 65B are second guiding portions.

Furthermore, when a width dimension of the engaging protrusion 66A is taken as W1, a width dimension of the engaging protrusion 66B as W2 (see FIG. 4A), an interval dimension between the groove formation portions 65A and 65B as S1, and an interval dimension from the groove formation portion 65B of the back side to the terminal piece 51B as S2 (see FIG. 2B), a width dimension of the engaging protrusions 66A and 66B and an interval dimension of the groove formation portions 65A and 65B are set so that a relationship of S1>W1 and S2>W2 holds.

When the toner cartridge 60 is to be mounted into the mounting position of the developer 55, the guide member guides the toner cartridge 60 to the back side of the rotation type development unit 50 by enabling sliding movement of the engaging protrusions 66A and 66B along the grooves of the groove formation portions 65A and 65B.

Then, at a stage when the toner cartridge 60 has been mounted into the mounting position of the developer 55 (that is, the stage when the female bracket 60A of the toner cartridge 60 has linked to the male bracket 51C of the rotation type development unit 50), the engaging protrusion 66A is positioned between the groove formation portions 65A and 65B, and the engaging protrusion 66B is positioned between the groove formation portion 65B and the terminal piece 51B. Thus, the engaging protrusions 66A and 66B and the groove formation portions 65A and 65B are in a non-contact state with an interval therebetween.

<Replacement Hole and Replacement Door>

Next, structures of a replacement hole and a replacement door are described.

Figure 7:
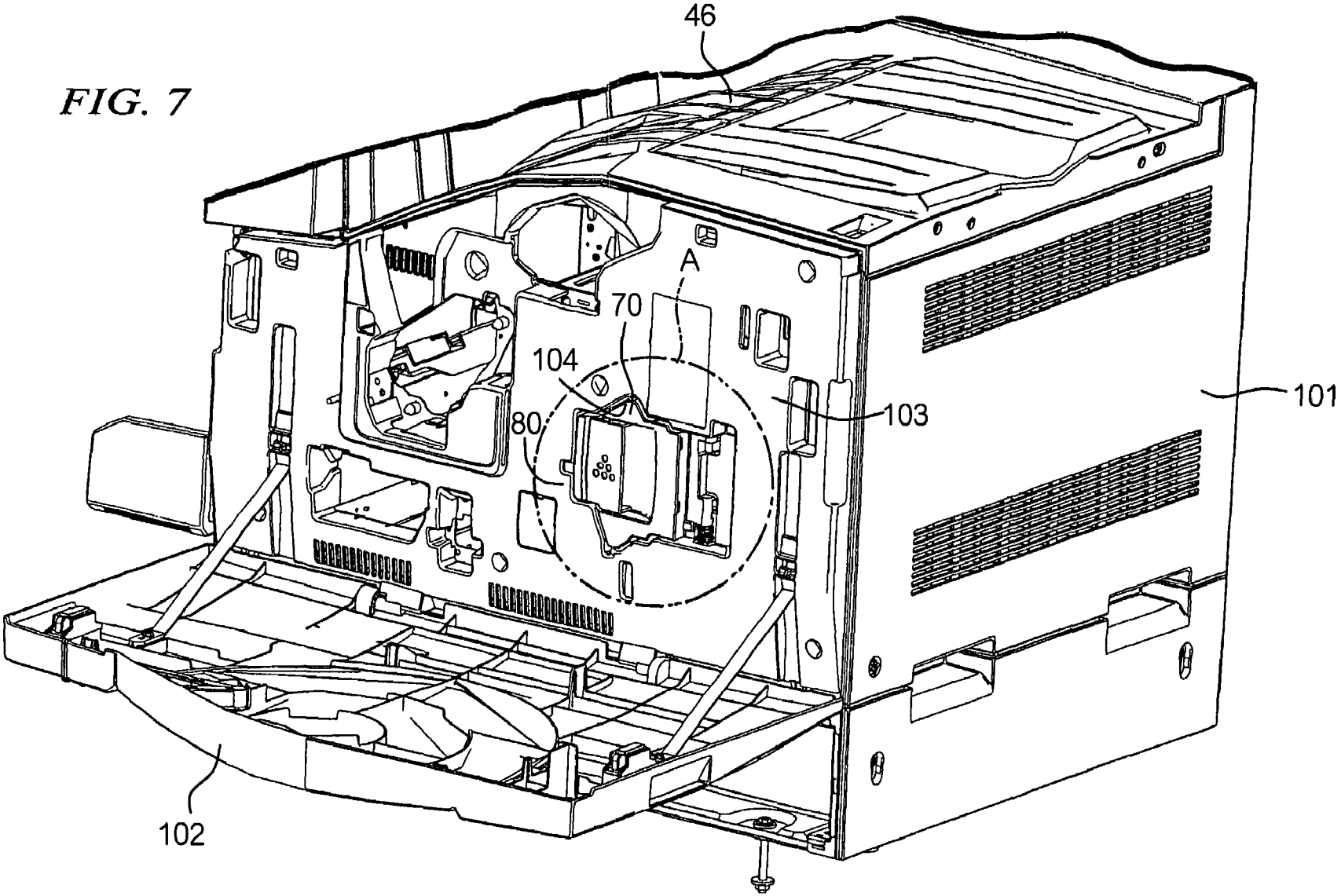
FIG. 7 shows a condition in which an outer door of the image forming unit according to an embodiment of the present invention is open.

FIG. 7 shows the casing 101 in which the image forming unit 10 of the multi-function machine 100 is accommodated.

An outer door 102 that opens/closes on a front side is provided on the casing 101. With the lower side in the drawing of this outer door 102 that is axially supported at an inner wall 103 of the casing 101 serving as a rotation center, the upper side of the outer door 102 opens outward. Then, the various areas of the image forming unit 10 are accommodated between the casing 101 and the inner wall 103. Furthermore, an outer door sensor 105 (see FIG. 14) that detects the closing of the outer door 102 is provided at the inner wall 103 or the outer door 102.

A replacement hole 104 is provided in the inner wall 103 in a position such that the toner cartridge 60 can be seen when the rotation type development unit 50 is rotated and stopped at a replacement position. Further still, a replacement door 70 that opens outward to open/close the replacement hole 104 is provided in an area of the inner wall 103 near the replacement hole 104. With its right side in the drawing that is axially supported serving as a rotation center, the replacement door 70 is cantilevered, and thereby the replacement hole 104 is opened/closed.

Figure 8A:
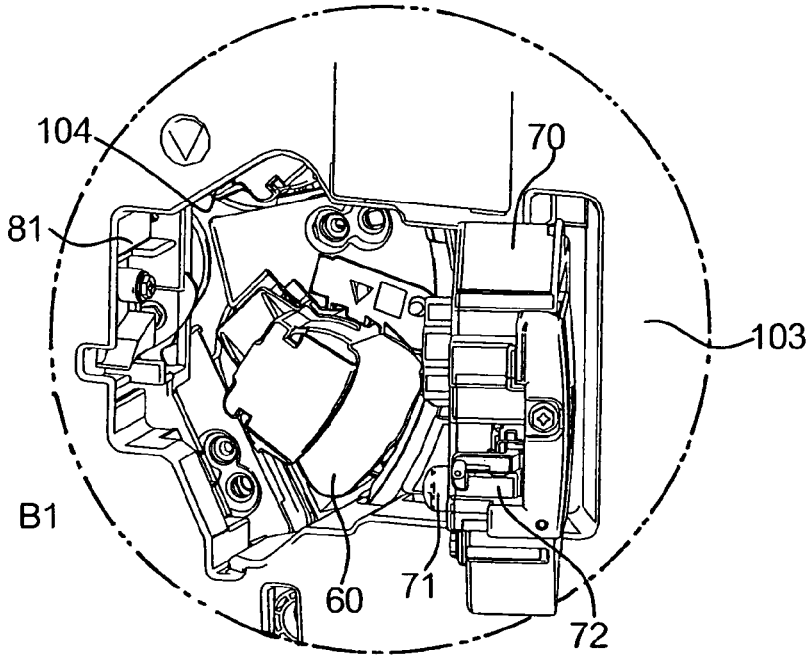
FIG. 8 shows an enlargement of an A area in FIG. 7.
Figure 8B:
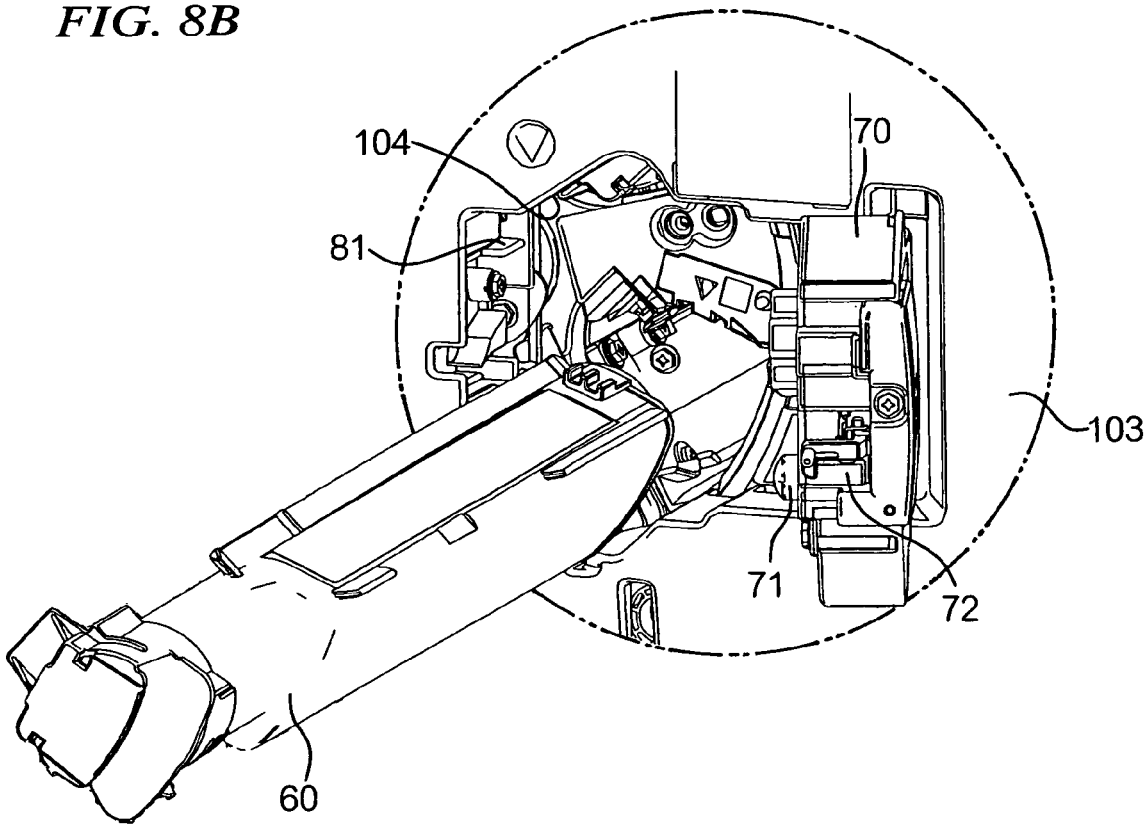

FIGS. 8A and 8B show enlargements of an A area in FIG. 7. FIG. 8A shows the replacement door 70 in an open state and FIG. 8B shows the toner cartridge 60 in a state withdrawn in a "B1" arrow direction. A pressing portion 71 is provided (see FIG. 8) in the replacement door 70 to press with a predetermined pressing force a rear side of the toner cartridge 60 when the toner cartridge 60 is inserted into the rotation type development unit 50.

A locking mechanism 80, which is a fastening mechanism for the replacement door, is provided at the end surface of the replacement door 70 and the end surface of the replacement hole 104 that faces this end surface. The locking mechanism 80 includes a striker 72, being a door side fastening part provided on the replacement door 70 side, and a latch 81, being a hole side fastening part provided on the replacement hole 104 side.

Figure 9:
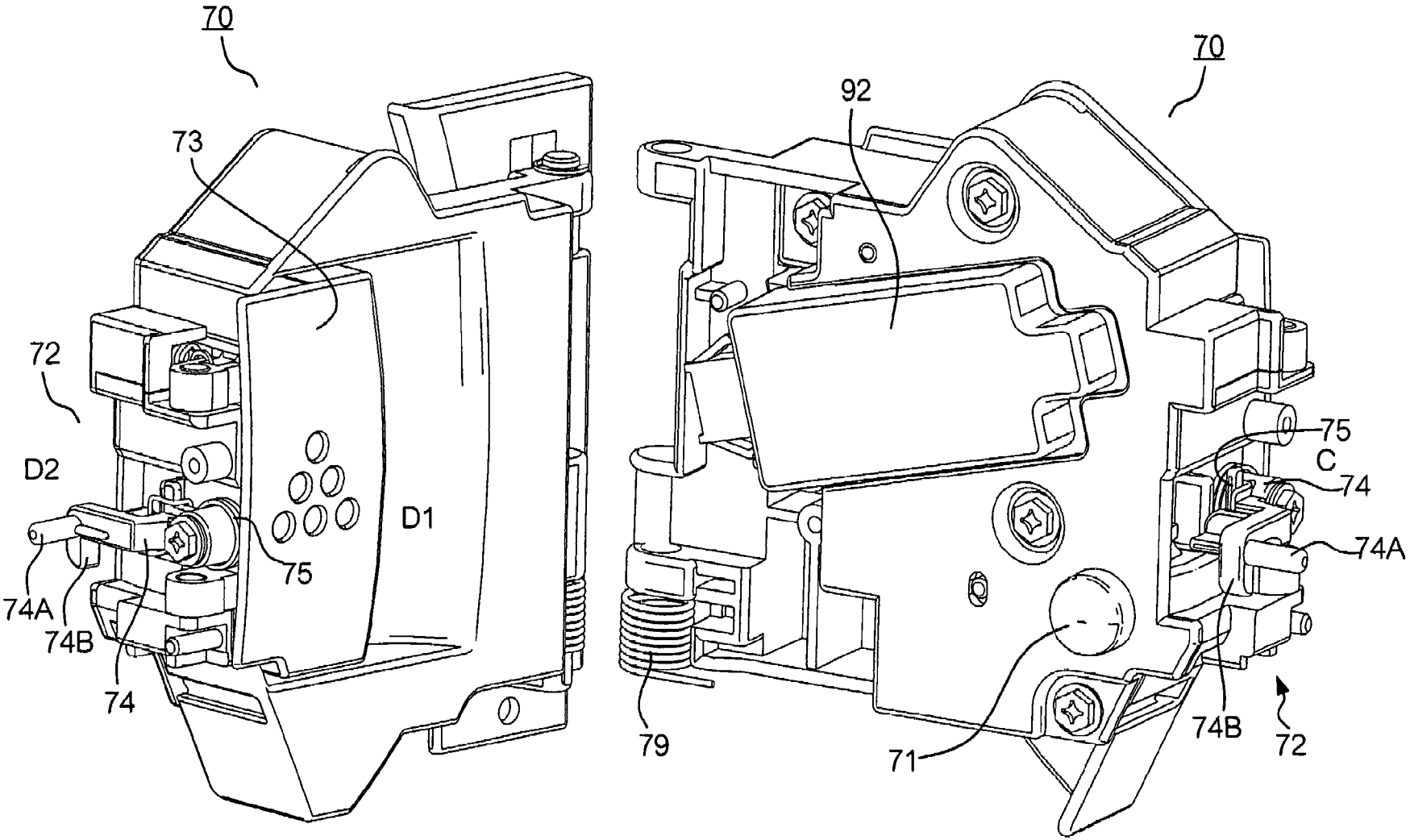
FIG. 9 is a perspective view of a replacement door according to an embodiment of the present invention.

Next, a configuration of the replacement door 70 is described with reference to FIG. 9. FIG. 9 shows perspective views of the replacement door 70 as viewed from a front surface and a rear surface. A door spring 79 is provided at a rotational center of the replacement door 70. When the locking mechanism 80 is not in a locked state, this door spring 79 applies a biasing force on the replacement door 70 in an open door direction.

The striker 72 provided at the end surface of the replacement door 70 is equipped with a handle 73 that is arranged to be rotatable in a "D1" arrow direction on the replacement door 70 and enables the locking mechanism 80 to be released, a striker member 74 whose starting end side is axially supported at an area of the handle 73 and acts as a door side rotating member capable of rotation in a "C" arrow direction, and a striker biasing spring 75, which is a door side biasing member that produces a biasing force in resistance to the force by which the striker member 74 rotates in the "C" arrow direction. At a leading end side of the striker member 74 are formed a pin 74A, which is a protruding member that protrudes outwardly, and an engaging claw 74B that protrudes downwardly.

Next, a configuration of the latch 81 is described with reference to FIG. 10. FIG. 10 shows perspective views of the latch 81 as viewed from a front surface and a rear surface.

The latch 81 is equipped with a hole side fastening member 82 that is fastened by a screw cramp to an end surface of the replacement hole 104, a latch member 83, which is a hole side rotating member axially supported so as to be rotatable in an "E" arrow direction on the fastening member 82 with its starting end as a rotation center, and a latch biasing spring 84, which is a hole side biasing member that produces a biasing force in resistance to the "E" arrow direction rotation of the latch member 83. A substantially triangular shaped slider 83A, which is a guiding portion that guides the pin 74A, is formed at a leading end of the latch member 83, and this slider 83A has an inclined surface whose inner side is higher. An engaging portion 82A, which is positioned further on the open door side than a position in which the pin 74A is pushed in by the slider 83A and engages the engaging claw 74B, is formed on the fastening member 82. Furthermore, the biasing force of the striker biasing spring 75 is set so as to be stronger than the biasing force of the latch biasing spring 84.

Further still, a switch 85 that acts as an inner door sensor is provided on a rear surface of the fastening member 82. When the latch member 83 rotates in the "E" arrow direction and the engaging claw 74B engages with the engaging portion 82A, a plate portion 85A moves in an "F" direction and the switch 85 outputs an ON signal.

<Operation of Locking Mechanism>

Figure 12A:
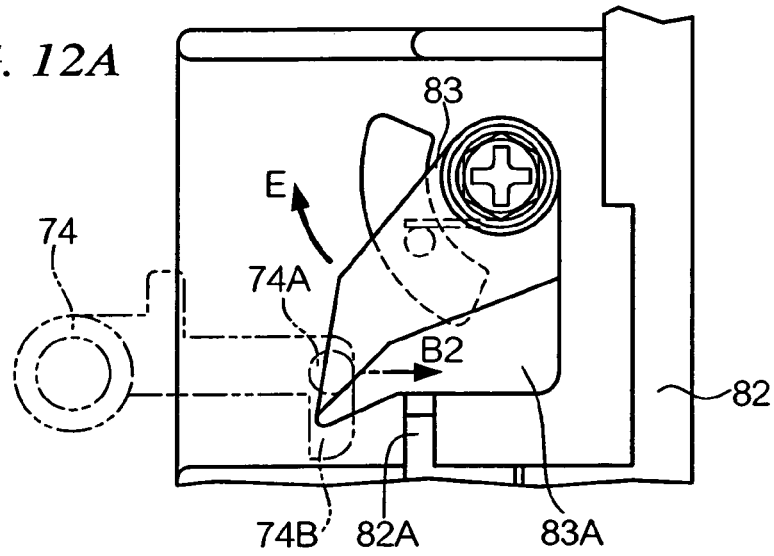
FIG. 12 shows the movement of a latch member and a striker member of a locking mechanism according to an embodiment of the present invention.
Figure 12B:
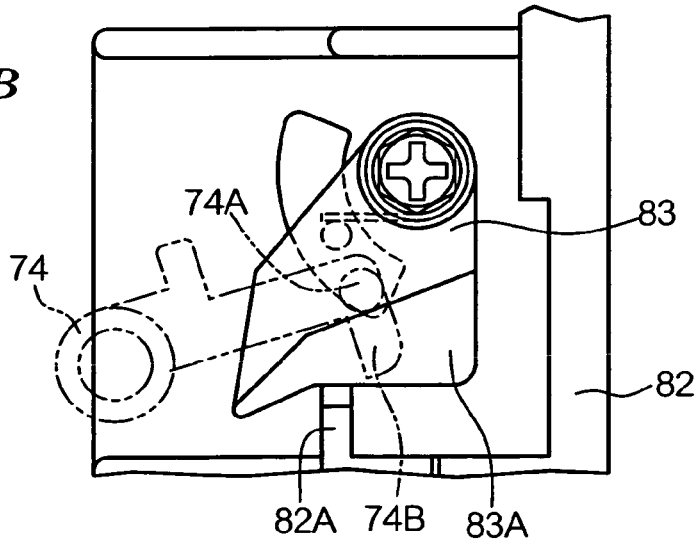
Figure 12C:
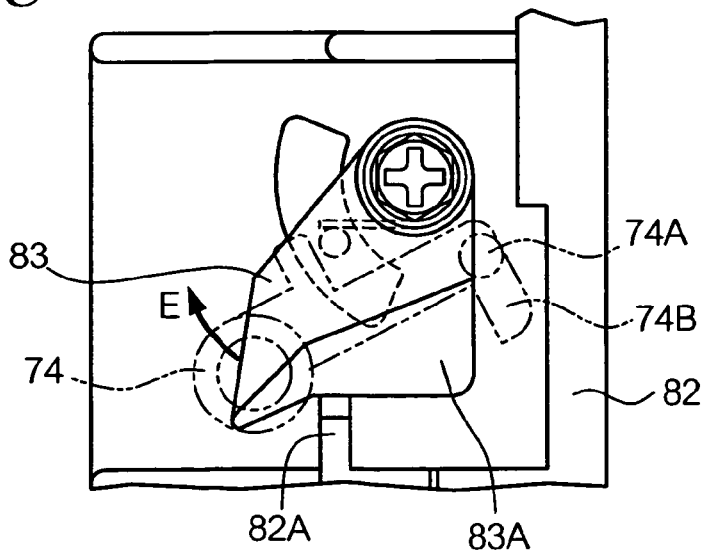
Figure 13D:
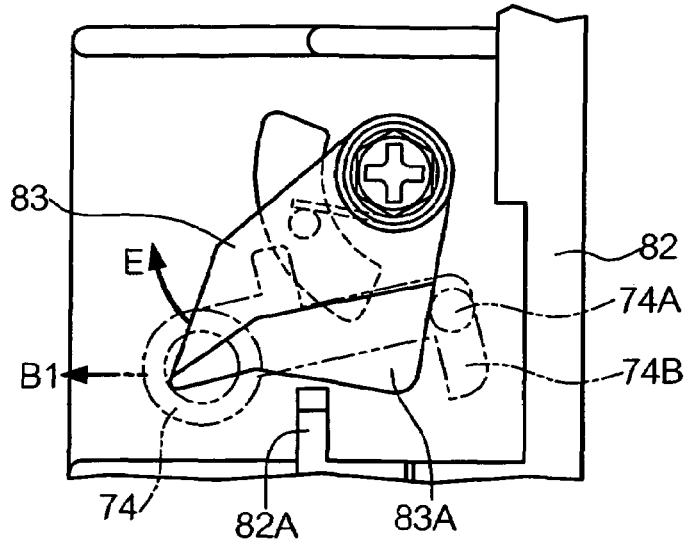
FIG. 13 is a continuation of FIG. 12.

Next, an operation of the locking mechanism is described with reference to FIGS. 11 to 13.

FIG. 11 illustrates a state when the toner cartridge 60 mounts into the mounting position of the developer 55.

An operator opens the outer door 102 and opens the replacement door 70. By pulling out the handle 73 in the "D1" arrow direction, the striker member of the replacement door 70 rotates in the "D2" arrow direction and the engaging claw 74B disconnects from the engaging portion 82A. The replacement door 70 receives the biasing force of the door spring 79 and opens. Then, due to rotation control of the rotation type development unit 50, the toner cartridge 60 for replacement can be seen at the replacement hole 104.

Figure 11A:
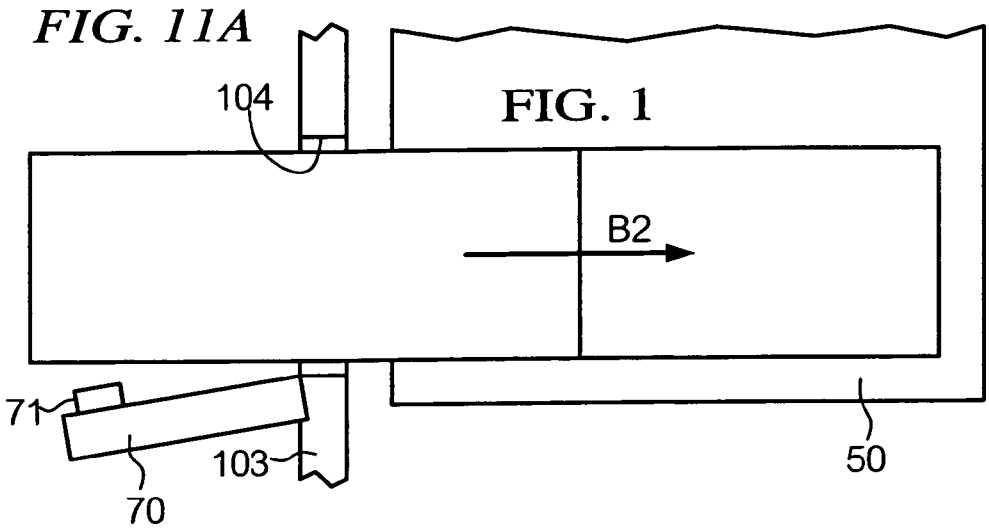
FIG. 11 schematically shows a state in which a toner cartridge inserts into a developer unit.
Figure 11B:
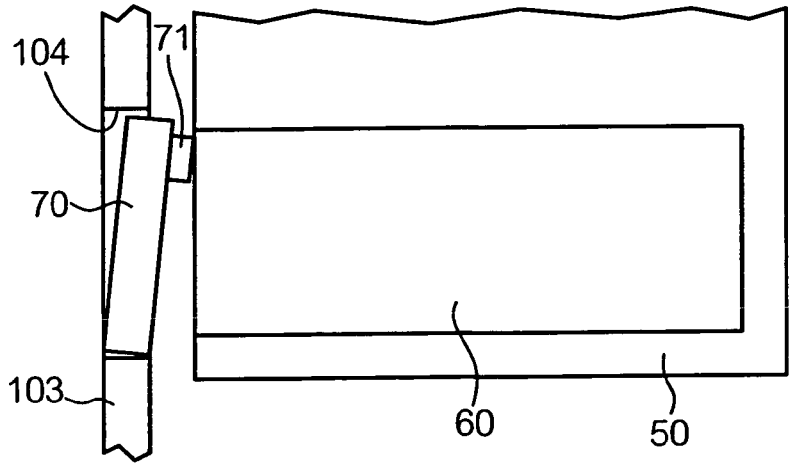
Figure 11C:
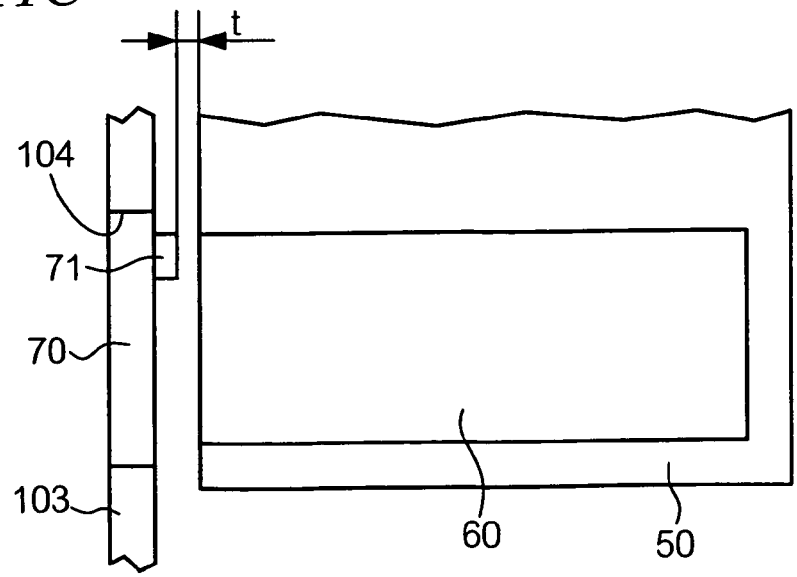

Next, the operator pulls out the toner cartridge 60 that is mounted in the developer 55, and inserts a new toner cartridge 60 in the rotation type development unit 50 in the "B2" arrow direction as shown in FIG. 11A. At a stage when the toner cartridge 60 has been inserted to a certain extent, the operator closes the replacement door 70 to mount the toner cartridge 60 into the mounting position in the developer 55 using the replacement door 70, which has been pushed in once to the rear. As shown in FIG. 11B, the replacement door 70 that has been pushed in once to the rear becomes locked by the locking mechanism 80 at a position where it has slightly returned to the opening side. At this point, as shown in FIG. 11C, a clearance t is maintained between the rotation type development unit 50 and the replacement door 70.

Furthermore, when the toner cartridge 60 is pushed into the rotation type development unit 50 by the replacement door 70, the pressing portion 71, which has a predetermined pressing force, pushes into the toner cartridge 60 from the rear side and the toner cartridge 60 is more reliably mounted in the mounting position of the developer 55 due to this pressing force. Moreover, even if the operator pushes the replacement door 70 strongly in the closing direction, the pressing portion 71 cushions the force applied to the toner cartridge 60 by its pressing force and it is possible to achieve protection for the toner cartridge 60.

FIGS. 12 and 13 show movement of the latch member 83 of the locking mechanism 80 and the striker member 74 when the replacement door 70 closes.

When the operator closes the replacement door 70, the striker member 74 moves in the "B2" arrow direction and the pin 74A of the striker member 74 moves in the "C" arrow direction along the inclined surface of the slider 83A of the latch 81, and the latch member 83 moves in the "E" arrow direction due to the relationship of the biasing forces of the striker biasing spring 75, the latch biasing spring 84, and the door spring 79.

First, since the replacement door 70 is pushed in a closing direction by the operator, the striker member 74 is caused to move in the "B2" arrow direction. Since the slider 83A of the latch member 83 does not move at this time, the pin 74A moves in the "E" arrow direction (upper side) along the inclined surface of the slider 83A (see FIG. 12A). Then, moving through the state shown in FIG. 12B, the pin 74A reaches the top of the slider 83A (see FIG. 12C). Here, the replacement door 70 is pressing in the toner cartridge 60 into the rotation type development unit 50 as shown in FIG. 11B. At this point in time, the operator stops pushing in the replacement door 70.

Having reached the top the slider 83A, the pin 74A descends along a vertical surface of the slider 83A due to a relationship of the striker biasing spring 75 and the latch biasing spring 84. On the other hand, since the replacement door 70 is being subjected to a biasing force by the door spring 79, the striker member 74 moves in the "B1" arrow direction. As a result, the vertical surface of the slider 83A is pushed by the pin 74A in the "B1" arrow direction such that the latch member 83 is caused to rotate in the "E" arrow direction (see FIG. 13D).

Figure 13E:
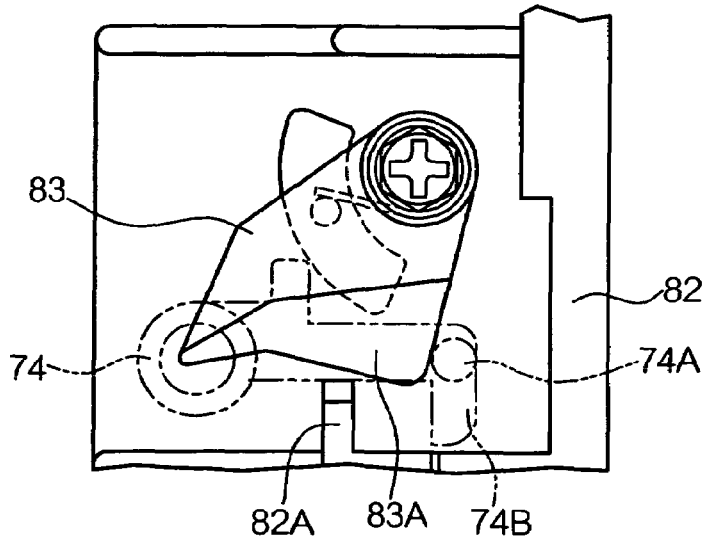
Figure 13F:
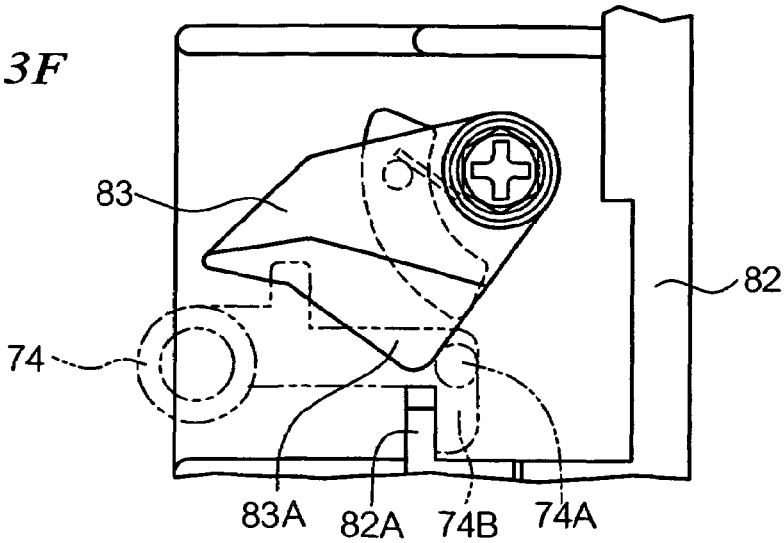

Then, passing through the state shown in FIG. 13E, the engaging claw 74B engages with the engaging portion 82A, and thereby the locking mechanism 80 puts the replacement door 70 into a fastened state (see FIG. 13F). At this point, as shown in FIG. 11C, a clearance t is maintained between the rotation type development unit 50 and the replacement door 70.

In this way, when replacing the toner cartridge 60 as shown in FIG. 11, at a stage when the toner cartridge 60 has been inserted to a certain extent, the operator carries out an operation of closing the replacement door 70 and mounts the toner cartridge 60 into the rotation type development unit 50 using the replacement door 70, which has been pushed in once to the rear. Having been pushed in once, the replacement door 70 is fastened at a position slightly returned on the open side than the pushed in position and the clearance t is maintained between the replacement door 70 and the rotation type development unit 50.

<Effect of Embodiment>

As described above, when replacing the toner cartridge 60, the operator opens the replacement door 70 and pulls out the toner cartridge 60 to be replaced, then inserts the new toner cartridge 60. At this time, the operator closes the replacement door 70 at a stage when the toner cartridge 60 has been inserted to a certain extent. Having been pushed inward once, the replacement door 70 securely mounts the toner cartridge 60 into the mounting position of the developer 55 due to the locking mechanism 80.

In this way, the operator can carry out mounting of the toner cartridge 60 easily by a series of comparatively simple operations involving inserting the toner cartridge 60 linearly and closing the replacement door 70.

Moreover, after the operator pushes in the replacement door 70 inward once, the replacement door 70 is put into a fastened state slightly returned to the open side due to the locking mechanism 80. In this state, since the clearance t is reliably maintained between the replacement door 70 and the rotation type development unit 50, it is possible to reliably prevent malfunctions such as the toner cartridge 60 flying out and protruding from the rotation type development unit 50 and contacting the inner wall 103 causing damage.

Further still, a guide member including engaging protrusions 66A and 66B and groove formation portions 65A and 65B that guides the toner cartridge 60 to the inner side of the rotation type development unit 50 is formed between the toner cartridge 60 and neighboring developer bodies 56. Moreover, the guide member is configured such that, at a stage when the toner cartridge 60 has been guided and mounted into the mounting position of the developer 55 (that is, the stage when the female bracket 60A of the toner cartridge 60 has linked to the male bracket 51C of the rotation type development unit 50), the engaging protrusions 66A and 66B and the groove formation portions 65A and 65B are moved away from each other to go into a disconnected state. Thus, it is possible to prevent vibration from the agitating auger inside the toner cartridge 60 and vibration from the auger that agitates toner inside the developer body 56 from being transmitted to neighboring developers.

Additionally, since transmission of vibration is prevented without using a structure such as dividing plates to divide the developers 55, the area that would have been occupied by the dividing plates can be secured for the capacity of the toner cartridges 60.

<Modified Example>

Figure 14:
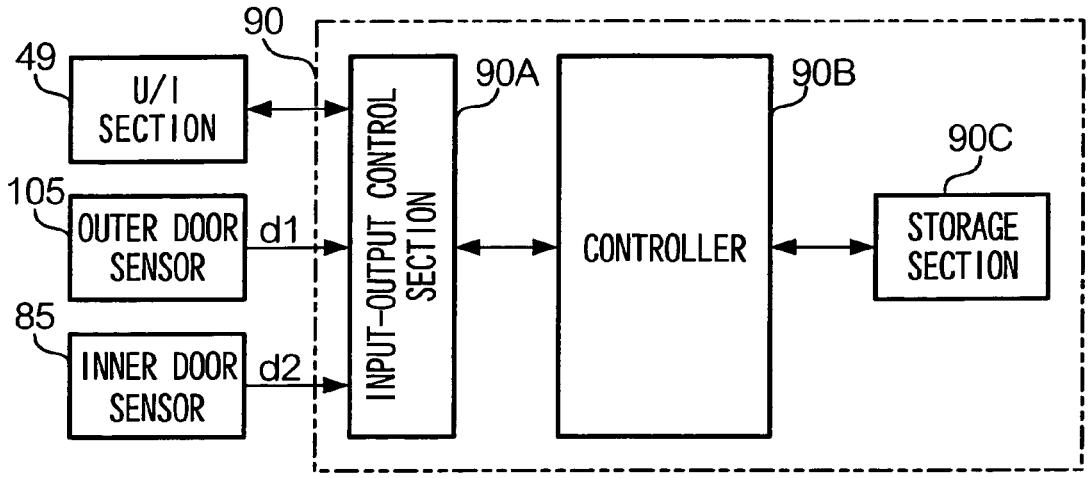
FIG. 14 is a control block diagram of a modified example.
Figure 15:
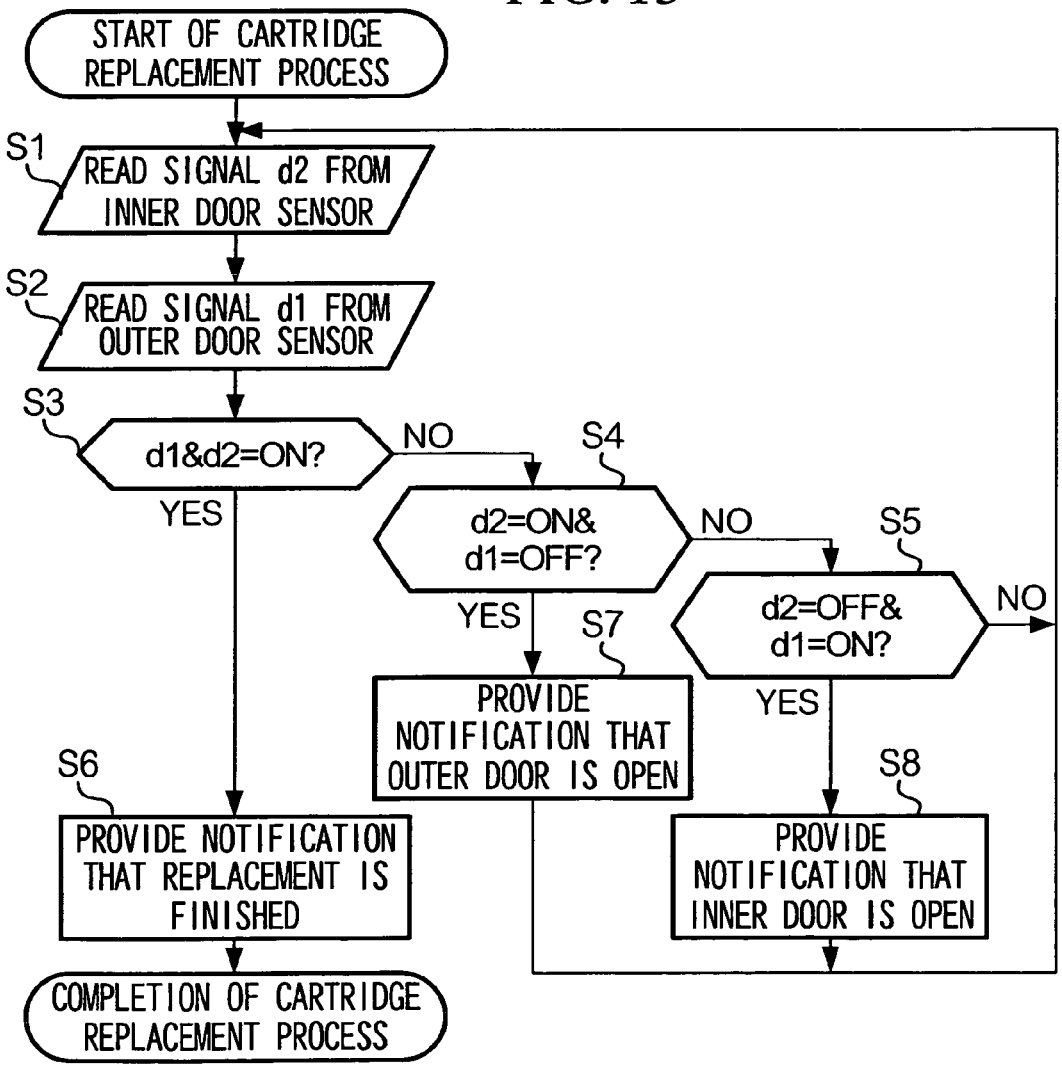
FIG. 15 is a flowchart of the modified example.

The above embodiment was described using a case in which whether or not replacement of the toner cartridge 60 had been carried out properly was determined by operation of the replacement door 70, but it is also possible to carry out judgment in the following manner using a control portion 90. FIG. 14 is a control block diagram and FIG. 15 is a flowchart of a cartridge replacement process.

The control portion 90 is constituted by components such as a CPU, a ROM, and a RAM, and is equipped with an input-output control section 90A, a controller 90B, and a storage section 90C. A U/I section 49, an outer door sensor 105, and an inner door sensor 85 are connected to the input-output control section 90A. A program or the like for the cartridge replacement process is stored in the storage section 90C.

The U/I section 49 is an operator interface 49 that enables an operator to carry out various operations and, as shown in FIG. 1, the U/I 49 includes a liquid crystal display functioning as a touch panel. The operator carries out various operations by touching the liquid crystal display.

Next, a cartridge replacement process is described with reference to FIG. 15.

First, the control portion 90 reads a signal d2 from the inner door sensor 85 (step S1) and reads a signal d1 from the outer door sensor 105 (step S2).

The control portion 90 determines whether or not the signals d1 and d2 are ON (step S3), whether or not only the signal d2 is ON (step S4), and whether or not only the signal d1 is ON (step S5).

When the result is "YES" at the determination process of step S3, both the doors 102 and 70 are securely closed and therefore the control portion 90 indicates on the U/I section 49 that the replacement is completed (step S6). On the other hand, when the result is "YES" at the determination process of step S4, the replacement door 70 is closed and the outer door 102 is open and therefore the control portion 90 indicates on the U/I section 49 that the outer door is open (step S7). Furthermore, when the result is "YES" at the determination process of step S5, the replacement door 70 is open and the outer door 102 is closed and therefore the control portion 90 indicates on the U/I section 49 that the inner door is open (step S8). Then, when the result is "NO" at the determination process of step S5, both the doors 102 and 70 are open and therefore it is considered that the replacement operation is in progress and the process returns to step S1.

In this way, replacement operations can be carried out very reliably by determining the state of the doors 102 and 70 based on the signals from the outer door sensor 105 and the inner door sensor 85 and provide notification to the operator via the U/I section 49.

Moreover, as shown in FIG. 9, a reading portion 92 that reads IC tag information is provided on an inner side of the replacement door 70. And an IC tag (not shown) on which various information is written, such as toner color, toner type, newness of the toner container, toner usage amount, destination information, and manufacturing company, is attached to a rear side in the insertion direction of the toner cartridge 60.

Since the clearance t is maintained between the rear side of the toner cartridge 60 and the replacement door 70 as shown in FIG. 11C, this enables a reduction in the reading errors that occur in the reading portion 92 when the distance between the reading portion 92 and the IC tag varies. Moreover, it is also possible to provide writing functionality to the reading portion 92 such that a remaining toner usage amount (remaining amount) can be written based on toner usage frequency (calculated from number of sheets for example) attached to the IC tag.

In the above-described embodiment, the inner door sensor 85 was provided on the latch 81 of the locking mechanism 80, but the present invention is not limited to this, and the inner door sensor 85 may be provided on the striker 72 side of the locking mechanism 80, the replacement door 70, or the replacement hole 104. It is only required that the inner door sensor is a sensor capable of detecting a state in which the locking mechanism 80 is fastening the replacement door 70 after the replacement door 70 has been pushed inward once.

In the above-described embodiment, the toner cartridge 60 was mounted into the mounting position of the developer 55 by an operation when the replacement door 70 opened outwardly, but the present invention is not limited to this, and this mounting may be performed with a pressing portion that presses the toner replenishment container, which has been inserted into the replacement hole, into a mounting position of the developer under interlocking with a closing operation of the replacement door, thereby mounting the toner replenishment container to the mounting position of the developer, and that fastens to the casing after mounting in a state apart from the rotation type development unit.

For example, with a configuration in which the replacement hole is opened by moving the replacement door up and down, the toner cartridge can be pushed inward by a pressing portion that moves under interlocking with a closing operation of the replacement door such that the toner cartridge mounts into mounting position of the developer. In other words, the effect by which the operator can carry out mounting of the toner cartridge easily by a series of comparatively simple operations involving inserting the toner cartridge linearly and closing the replacement door can also be achieved using this example.

Further still, it is possible to adopt a configuration in which the pressing portion is provided on the replacement door, wherein the pressing portion is provided on the casing side so as to operate upon receiving a door-closing operation of the replacement door. It is only required that the toner replenishment container is mounted in the mounting position by being pushed into the mounting position in an area in which it is fastened to the casing in a state apart from the rotation type development unit after mounting.

The above embodiment was described using an example of a case in which the toner image was transferred to the intermediate transfer belt by a transfer part, but there is no limitation to this and the toner image may be transferred directly to a recording sheet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

a casing;

a rotation type development unit having a plurality of developers and a rotational body that is rotatably supported on the casing, the plurality of developers being able to be mounted with a toner replenishment container filled with toner, and being disposed on a peripheral surface of the rotational body;

the casing defining a replacement hole that is provided in a position that links to a mounting position at which the toner replenishment container of one of the developers is to be mounted when the rotational body stops rotating at a predetermined position, the toner replenishment container inserting into the replacement hole when the toner replenishment container mounts into the developer;

a replacement door that opens the replacement hole when the replacement door is opened and closes the replacement hole when the replacement door is closed; and a pressing portion that presses the toner replenishment container that is inserted into the replacement hole into a mounting position of the developer under interlocking with a closing operation of the replacement door, and mounts the toner replenishment container to the mounting position of the developer, and is fastened to the casing after mounting in a state apart from the rotation type development unit.

2. An image forming apparatus, comprising:

a casing;

a rotation type development unit having a plurality of developers and a rotational body that is rotatably supported on the casing, the plurality of developers being able to be mounted with a toner replenishment container filled with toner, and being disposed on a peripheral surface of the rotational body;

the casing defining a replacement hole that is provided in a position that links to a mounting position at which the toner replenishment container of one of the developers is to be mounted when the rotational body stops rotating at a predetermined position, the toner replenishment container inserting into the replacement hole when the toner replenishment container mounts into the developer;

a replacement door that opens the replacement hole when the replacement door is opened, and closes the replacement hole when the replacement door is closed; and a replacement door fastening mechanism that, after the replacement door is closed in a state that the toner replenishment container is inserted into the replacement hole and after the toner replenishment container is pressed by the replacement door and mounted into a mounting position of the developer by being pushed inside the replacement hole by the replacement door, causes the replacement door to return and stop at a closed position and fastens the replacement door in a state that the replacement door and the rotation type development unit are apart in the closed position.

3. The image forming apparatus according to claim 2, wherein the replacement door opens outwardly to open and close the replacement hole, the replacement door fastening mechanism comprises:

a door side fastening unit provided at the replacement door and a hole side fastening unit provided at the replacement hole;

the door side fastening unit comprises:

a handle that is axially supported at the replacement door and releases the replacement door fastening mechanism;

a door side rotating member that is axially supported on the handle at one end of the door side rotating member as a rotational center and that is integrally formed by a protrusion portion and an engaging claw protruding from the replacement door at another end of the door side rotating member; and a door side biasing member that applies a biasing force on the door side rotating member in one direction, the hole side fastening unit comprises:

a hole side fastening member that fastens in the replacement hole;

a hole side rotating member that is axially supported on the hole side fastening member at one end of the hole side rotating member as a rotational center and that has a guiding portion guiding the protrusion portion at another end of the hole side rotating member;

an engaging portion formed at the hole side fastening member positioned more on an open door side than a position at which the protrusion portion is pushed by the guiding portion and engages the engaging claw of the door side rotating member; and a hole side biasing member that applies a biasing force on the hole side rotating member in another direction;

wherein, when the door side rotating member rotates in resistance to the door side biasing member and the protrusion portion is guided by the guiding portion and the replacement door is pushed inside the replacement hole in order to close the replacement door, guidance to the protrusion portion by the guiding portion is released and the engaging claw engages the engaging portion.

4. The image forming apparatus according to claim 3, wherein the biasing force of the door side biasing unit is stronger than the biasing force of the hole side biasing unit.

5. The image forming apparatus according to claim 2, further comprising, a door biasing unit for biasing the replacement door in an open-door direction, wherein the biasing force of the door biasing unit is stronger than the biasing force of the hole side biasing unit.

6. The image forming apparatus according to claim 2, further comprising a mechanism that produces elasticity against an insertion direction of the toner replenishment container at a position where the replacement door contacts the toner replenishment container when the replacement door is pushed inside the replacement hole.

7. The image forming apparatus according to claim 2, further comprising a fastening detection unit that detects that the replacement door is fastened in the door-closed position and that is provided in at least one of the replacement door fastening mechanism, the replacement door, and the replacement hole.

8. The image forming apparatus according to claim 2, further comprising a detection unit that detects information relating to a toner replenishment container including at least a color of a toner filled in the toner replenishment container.

9. The image forming apparatus according to claim 8, wherein the detection unit comprises:

an information storage section that is attached to each of the toner replenishment containers and stores toner information including a color of a toner filled in the toner replenishment container; and a reading portion that is provided at the replacement door and that reads out the toner information stored in the information storage section.

10. A rotation type development unit, comprising:

a rotational body that rotates around a rotational shaft;

a plurality of developer bodies that are arranged on a peripheral surface of the rotational body and that have a toner holding chamber for holding toner taken in from a toner replenishment outlet and a developing agent supporter that develops an electrostatic latent image formed on an image carrier using toner supplied from the toner holding chamber;

a toner replenishment container that inserts in a direction parallel to the rotational shaft between a first developer body and a second developer body neighboring each other and that replenishes toner into the toner holding chamber through a replenishment outlet linking to the toner replenishment outlet;

a first guiding portion provided at the toner replenishment container; and a second guiding portion provided at an area of the first developer body and an area of a second developer body that are opposed to an area in which the first guiding portion of the toner replenishment container that is inserted is arranged, wherein, in a process of inserting the toner replenishment container, the toner replenishment container being guided in a direction parallel to the rotational shaft of the rotational body by the first guiding portion and the second guiding portion, and the first guiding portion and the second guiding portion being apart from each other after the toner replenishment container is inserted.

11. The rotation type development unit according to claim 10, wherein the first guiding portion and the second guiding portion comprise:

a protruding member formed extending in a direction parallel to the rotational shaft in one of the developer body and the toner replenishment container; and a recessed member formed in a shape that engages with the guiding portion in the other of the developer body and the toner replenishment container, wherein the protruding member and the recessed member form a notched portion apart from each other after the toner replenishment container is inserted.

12. A toner replenishment container comprising:

a container body that is filled with toner for replenishing a developer side, and a guided portion that, in a process of inserting the toner replenishment container, guides the toner replenishment container in a direction parallel to a rotational shaft of a rotational body by engaging with a guiding portion provided on a developer body side, and that is apart from the guiding portion arranged on the developer side after the toner replenishment container is inserted, the toner replenishment container inserting between neighboring developer bodies in a direction parallel to the rotational shaft, the neighboring developer bodies being arranged on a peripheral surface of a rotational body that rotates around a rotational shaft.

* * * * *